US008479768B2

(12) United States Patent
Kunz et al.

(10) Patent No.: US 8,479,768 B2
(45) Date of Patent: Jul. 9, 2013

(54) DIRECTIONAL CONTROL VALVE ARRANGEMENT

(75) Inventors: Reiner Kunz, Sachsenheim (DE); Andreas Albrecht, Stuttgart (DE); Markus Grammer, Stuttgart (DE); Steffen Knapper, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 277 days.

(21) Appl. No.: 12/840,318

(22) Filed: Jul. 21, 2010

(65) Prior Publication Data

US 2011/0017321 A1 Jan. 27, 2011

(30) Foreign Application Priority Data

Jul. 27, 2009 (DE) ..... 10 2009 034 616

(51) Int. Cl.
*F15B 13/04* (2006.01)

(52) U.S. Cl.
USPC ..... 137/596.14

(58) Field of Classification Search
USPC ..... 137/554, 596, 625.6, 596.14
See application file for complete search history.

(56) References Cited

U.S. PATENT DOCUMENTS

| | | | | |
|---|---|---|---|---|
| 3,125,120 | A * | 3/1964 | Hasbany | 137/596.12 |
| 3,126,031 | A * | 3/1964 | Hayner | 137/625.62 |
| 3,216,448 | A * | 11/1965 | Stacey | 137/596.2 |
| 3,595,271 | A * | 7/1971 | Nelson | 137/596.2 |
| 3,662,783 | A * | 5/1972 | Stacey | 137/596.14 |
| 3,726,093 | A * | 4/1973 | Malott | 60/445 |
| 5,785,087 | A * | 7/1998 | Takahashi et al. | 137/625.65 |
| 6,158,462 | A * | 12/2000 | Kashiwagi et al. | 137/596 |
| 6,637,461 | B2 * | 10/2003 | Post | 137/625.63 |
| 2004/0221896 | A1 * | 11/2004 | Ballenger et al. | 137/554 |
| 2005/0011556 | A1 * | 1/2005 | Dudzik et al. | 137/554 |

FOREIGN PATENT DOCUMENTS

DE 196 27 306 1/1998

OTHER PUBLICATIONS

Rexroth Bosch Group "Control Block" RDE 66 132-01-R1, Mar. 2007 (in English).

* cited by examiner

*Primary Examiner* — Eric Keasel
*Assistant Examiner* — Reinaldo Sanchez-Medina
(74) *Attorney, Agent, or Firm* — Michael J. Striker

(57) ABSTRACT

A directional control valve arrangement includes a directional control valve with a valve spool. Using the directional control valve, it is possible to control a pressure-medium connection between a pressure port, a tank connection, and at least one working connection. A blocking valve is situated in a working passage that is connected to the working connection. The pressure in the working passage can be reduced using a pressure-release unit; the pressure-medium connection between the working passage and the tank connection is blocked by the valve spool. The pressure-relief unit has an intermediate space which is formed in the pressure-medium flow path between the blocking valve and a control edge of the valve spool that blocks the working passage to the tank port, the intermediate space being provided to accommodate a compression volume of the working passage. The intermediate space can be connected to the working passage by controlling-open the blocking valve, and the connection to the tank port is blocked by the control edge of the valve spool.

11 Claims, 4 Drawing Sheets

DIRECTIONAL CONTROL VALVE ARRANGEMENT

BACKGROUND OF THE INVENTION

The invention relates to a directional control valve arrangement.

A directional control valve arrangement of this type is made known in DE 196 27 306 A1. It includes a manually-actuated directional control valve having a blocking valve and pressure-limiting valve in a consumer passage. The purpose of the blocking valve is to minimize a load reduction on the consumer side caused by leakage from the directional control valve. In the case of a line system that is connected to the consumer passage, the blocking valve, which performs a sealing function, can cause an impermissibly high pressure to occur in the line system and in the consumer passage if extraneous heat is applied, e.g. solar radiation or heat dissipated by machinery. The impermissibly high pressure can damage the directional control valve arrangement, the line system and valves connected thereto. The pressure-limiting valve situated in the consumer passage is used to reduce the impermissibly high pressure and therefore prevent it from forming.

The blocking valve and its precontrol are controlled open by a plunger. The plunger can be mechanically actuated in the control-open direction using a connecting member formed on a valve spool of the directional control valve. The consumer passage can be connected to an intermediate chamber via the blocking valve and the pressure-limiting valve, wherein a pressure-medium connection between the intermediate chamber and a tank chamber can be controlled using the valve spool of the directional control valve. In addition, the intermediate chamber is connected to the tank chamber via a throttled passage, wherein the throttled passage is the gap between the valve spool and a valve housing that accommodates the valve spool.

If the pressure is impermissibly high, the pressure-limiting valve opens, thereby allowing pressure medium to flow from the consumer passage to the intermediate passage and, from there, via the throttled passage to the tank chamber.

A further solution for reducing an impermissibly high pressure in a consumer line in the presence of a directional control valve arrangement is presented in data sheet RD 66 132-01-R1/03.Q7 published by the applicant. According to the aforementioned solution, a blocking valve is situated in the consumer passage, as is the case in the previous publication. To limit the impermissibly high pressure, a thermo pressure-limiting valve is provided in a separate bore of a valve spool of the directional control valve arrangement. When a certain impermissibly high pressure is reached, a pressure-medium connection between the consumer passage and a tank passage is controlled open by the thermo pressure-limiting valve.

The disadvantage of the above-mentioned directional control valve arrangements is that the pressure-limiting valves are cost-intensive components having a complex design, require that the impermissibly high pressure to be limited be adjusted, and require a great deal of installation space.

SUMMARY OF THE INVENTION

In contrast, the problem to be solved by the invention is that of creating a directional control valve arrangement which can be used to limit the pressure of the pressure medium loaded between a consumer and the directional control valve arrangement in a cost-effective, space-saving manner.

According to the invention, a directional control valve arrangement comprises a directional control valve that includes a valve spool. Using the directional control valve, it is possible to control a pressure-medium connection between a pressure passage, a discharge passage, and two working passages. A releasable blocking valve is provided in one working passage at the least. If the working passage is blocked toward the discharge passage by the valve spool, pressure in the working passage can be relieved using a pressure-relief unit. The pressure-relief unit is provided in the form of an intermediate space which is located in the pressure-medium flow path between the blocking valve and a control edge of the valve spool that blocks the consumer passage toward the discharge passage, and which is designed to receive a compression volume of the consumer passage. The consumer passage, which is blocked by the control edge, can be connected to the working passage by controlling-open the blocking valve. This solution has the advantage that pressure in the working passage is relieved using simple devices, and is integrated in the directional control valve arrangement in a space-saving manner. A pressure-limiting valve of the type described in the prior art mentioned initially is no longer required.

Advantageously, the blocking valve includes a precontrol. As a result, pressure in the working passage can be relieved, e.g. if the temperature in the working passage increases, using the precontrol which can be controlled open using minimal forces. In a further embodiment of the invention, the blocking valve and the precontrol of the blocking valve can be controlled open mechanically.

The blocking valve and its precontrol can be controlled open using simple devices, simply by using a plunger that can be actuated in the controlled-open position by a connecting member on the valve spool.

The intermediate space for receiving the compression volume of the consumer passage can be partially bounded in a space-saving manner by a control collar of the valve spool that forms the control edge.

Gap leakage between the intermediate space and the discharge passage can be advantageously provided via the valve spool to relieve the pressure from the intermediate space.

Preferably, pressure is released from the working passage in a timed manner as a function of a temperature increase that is measured, in particular in the working passage, so that the compression volume can be accommodated in the intermediate space.

Preferably, a displacement sensor is provided on the valve spool of the directional control valve, thereby making it possible to exactly control the controlling-open of the blocking valve using the valve spool and the plunger.

Advantageously, an electronic assembly for controlling-open the directional control valve is situated on the directional control valve.

BRIEF DESCRIPTION OF THE DRAWINGS

A preferred embodiment of the invention is explained in the following in greater detail with reference to schematic drawings. The figures show.

DETAILED DESCRIPTION OF THE PREFERRED EMBODIMENTS

Figure 1:
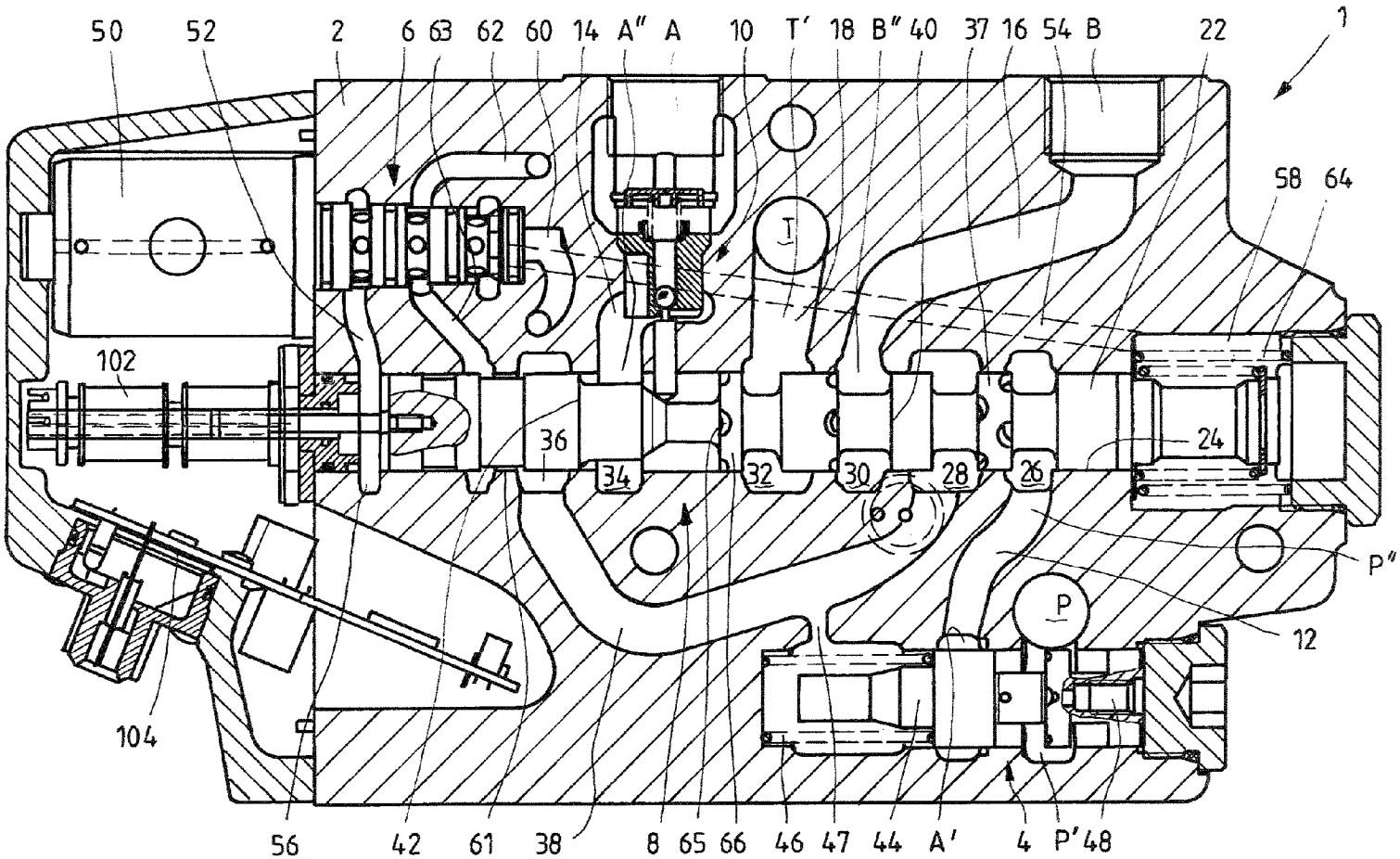
FIG. 1: a longitudinal sectional view of a directional control valve arrangement according to one embodiment.

FIG. 1 shows a directional control valve 1 of an LS directional control valve block in a longitudinal sectional view according to one embodiment. Directional control valve 1 is accommodated in a housing 2 having a plate-type design, and includes a pressure passage P connected to a pressure port, a tank passage T connected to a tank port, and two working connections A, B. Directional control valve arrangement 1 also includes an individual pressure compensator 4, a directional control valve 8 that is controlled by a pilot valve 6, and a blocking valve 10 that is situated in working connection A on the left, as shown in FIG. 1.

The basic design of directional control valve arrangement 1 is known and substantially corresponds to valve SB 23 LS from the applicant, and therefore only those details that are required to facilitate understanding are described.

Pressure passage P of directional control valve arrangement 1 is connected to an inlet port P' of individual pressure compensator 4 having an outlet port A' that has a pressure-medium connection via an inlet passage 12 to an inlet port P" of proportional directional control valve 8. Directional control valve 8 includes inlet port P" and two working connections A" and B", each of which is connected via a working passage 14 or 16, respectively, to working connection A or B, respectively, of directional control valve arrangement 1. A tank port T of directional control valve 1 has a pressure-medium connection via a discharge passage 18 to tank passage T of directional control valve arrangement 1.

A valve spool 22 of directional control valve 8 is displaceably guided in an axial direction in a valve bore 24 formed in housing 2. Six axially interspaced control chambers 26, 28, 30, 32, 34 and 36 are formed in valve bore 24.

Control chamber 26 is connected to inlet port P". The pressure-medium connection between control chamber 26 and adjacent control chamber 28 can be controlled using a metering orifice 37 of valve spool 22. Control chamber 28 is connected via an intermediate passage 38 to control chamber 36 shown on the left in FIG. 1. Working connections A" and B" of directional control valve 8 have a pressure-medium connection to control chambers 34 and 30, respectively. Via a control edge 40 of a first control collar of valve spool 22, control chamber 28 can be connected to control chamber 30 or working connection B", and control chamber 36 can be connected via a control edge 42 of a second control collar to control chamber 34 or working port A". A pressure differential and, therefore, a volumetric flow rate at metering orifice 37 can be held constant, independently of load, using a pressure-compensator plunger 44 of individual pressure compensator 4. Pressure-compensator plunger 44 is acted upon in the opening direction by a spring force of a pressure regulator spring 46 and by a pressure that is tapped downstream of metering orifice 37 of valve spool 22 of directional control valve 8, wherein the pressure is tapped at a passage 47 that branches off from intermediate passage 38. In the closing direction, pressure-compensator plunger 44 is acted upon by pressure upstream of metering orifice 37, this pressure being tapped at a control passage 48 of outlet port A' of individual pressure compensator 4.

Valve spool 22 of directional control valve 8 is displaced continuously by electrically actuated pilot valve 6 which is designed e.g. as a 4/3 pressure reduction valve. A valve spool, which is not depicted in FIG. 1, of pilot valve 6 can be actuated using a proportional actuating magnet 50. Pilot valve 6 is connected to a first and second control line 52, 54, respectively, wherein first control line 52 is connected to a control chamber 56—which is shown on the left in FIG. 1—of directional control valve 8, and second control line 54 is connected to a control chamber 58 on the right. Using pilot valve 6, a pressure-medium connection between control line 52 and 54 and a pilot line 60 can be controlled, wherein one of the control lines 52, 54 is connected to pilot line 60, and the other is connected to a tank line 62, or both control lines 52, 54 are connected to tank line 62 to relieve pressure from control chambers 56, 58. Depending on how pilot valve 6 is controlled open by actuating magnet 50, the pressure in pilot line 60 is reduced to a desired control pressure to actuate valve spool 22 of directional control valve 8.

Tank line 62 of pilot valve 60 is furthermore connected to an oil-leakage drain line 63 which is connected via an annular gap 61 between valve spool 22 and valve bore 24 of directional control valve 8 to control chamber 36.

Valve spool 22 of directional control valve 8 is preloaded, via a centering spring assembly 64 in control chamber 58, in its home position depicted in FIG. 1, in which the pressure-medium connection of inlet port P" to control chamber 28 is controlled closed, and the pressure-medium connection between control chambers 28, 36 and working connections A", B" is controlled closed.

To displace valve spool 22 of directional control valve 8 to the right, as shown in FIG. 1, and, therefore, to establish a pressure-medium connection between inlet port P" and working connection B", valve spool 22 can be acted upon by the control pressure via control chamber 56 on the left, wherein control chamber 56 is connected to pilot line 60 via first control line 52 and via pilot valve 6, and control chamber 58 is relieved to tank line 62 via control line 54 and pilot valve 6. In this direction of displacement, using a control edge 65 of a control collar 66 of valve spool 22, the pressure-medium connection of working connection A" is controlled open via control chamber 34 toward control chamber 32 and, therefore, toward discharge passage 18. To displace valve spool 22 from the home position shown at the left in FIG. 1, it is acted upon by the control pressure via control chamber 58 on the right, wherein control chamber 58 is connected via second control line 54, via pilot valve 6 to pilot line 60, and control chamber 58 on the left is connected via first control line 52, via pilot valve 6 to tank line 62. In this direction of displacement, the pressure-medium connection between inlet port P" and working connection A", and between working connection B" and tank port T' is controlled open.

Figure 2:
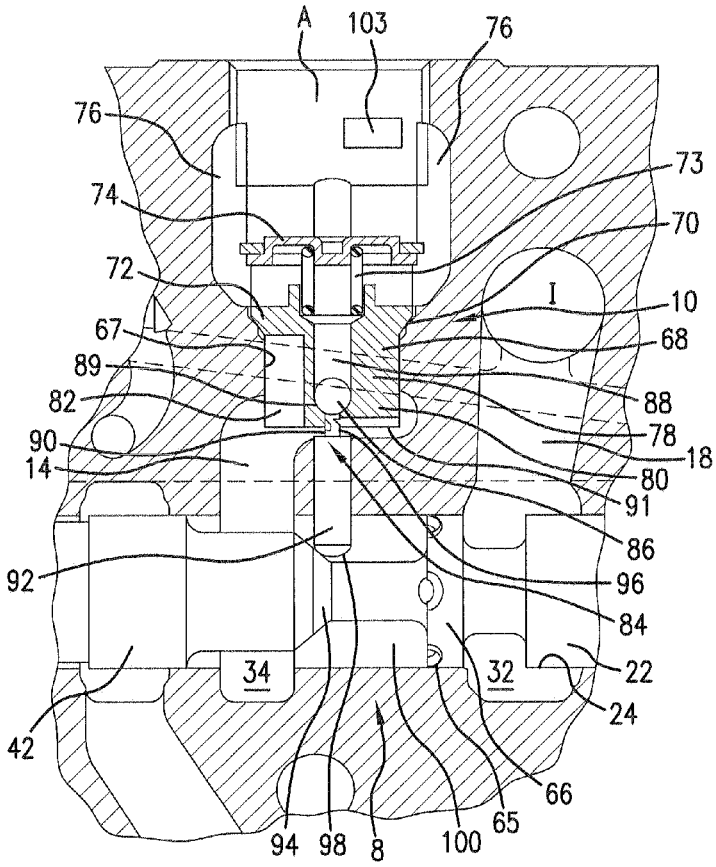
FIG. 2: a blocking valve of the directional control valve arrangement, in an enlarged depiction.

FIG. 2 shows an enlarged section of directional control valve 1 depicted in FIG. 1, in the region of blocking valve 10. Blocking valve 10 is situated in working passage 14 to minimize a load reduction on the consumer side that occurs due to leakage via directional control valve 8. Blocking valve 10 includes a blocking valve body 68 that is guided in a blocking valve bore 67. In the blocked state, blocking valve body 68 bears via a conical seat surface 70 against a blocking valve seat 72. Blocking valve body 68 is preloaded by a valve spring 73 against blocking valve seat 72, wherein the spring bears against a holding plate 74 that is installed. Holding plate 74 lies in the bottom region of working connection A. To ensure that flow occurs around the outside of holding plate 74, at least two identical recesses 76 are provided in the vicinity of holding plate 74, in a bore hole of working connection A.

A valve body shaft 78 adjoins conical seat surface 70 of blocking valve body 68 and extends away from working connection A. Valve body shaft 78 includes a core region, about which three radially extending, rib-type guide segments 80 are situated in order to guide blocking valve body 68 in blocking valve bore 67, wherein one guide segment 80 is shown in the view in FIG. 2. Pressure medium flows into intermediate spaces 82 between guide segments 80 when blocking valve 10 is open.

A precontrol 84 for blocking valve 10 is formed in the core region of valve body shaft 78. The blocking direction of the precontrol corresponds to that of blocking valve 10. A spherical precontrol body 86 is situated in a two-staged precontrol bore 88 in blocking valve 10, wherein blocking valve 10 is preloaded via a not-shown spring against a step 89, which is designed as a seat, of precontrol bore 88 and closes a precontrol bore 90. A transverse passage 91 that is open toward the bottom is milled into an underside of valve body shaft 78, transverse passage 91 intersecting precontrol bore 90.

Blocking valve body 68 and precontrol body 86 can be controlled open using a plunger 92. Plunger 92 is guided approximately perpendicularly to an axis of valve spool 22 of directional control valve 8 in housing 2, and can be displaced in the controlled-open position of blocking valve 10 using a connecting member 94 which is formed on valve spool 22 between second control edge 42, which is shown on the left in FIG. 2, and adjacent control collar 66. Connecting member 94 has a circumference shaped approximately as a truncated cone, the diameter of which decreases in the direction toward control collar 66. Plunger 92 includes an end section 96 that is offset radially rearward and extends away from valve spool 22, end section 96 being inserted into auxiliary bore 90 in blocking valve body 68 to actuate it.

In the home position of valve spool 22 of directional control valve 8, which is depicted in FIG. 2, plunger 92 bears against connecting member 94 via an end face 98 that faces away from blocking valve 10 in the region of the minimal diameter of connecting member 94. When valve spool 22 is displaced to the right, as shown in FIG. 1, plunger 92 glides via end face 98 along connecting member 94 and is therefore displaced in the direction of blocking valve 10, wherein the end section 96 of plunger 92 moves precontrol body 86 of precontrol 84 in the opening direction. Precontrol 84 is opened before the pressure-medium connection between working passage 14 and discharge passage 18 is controlled open using control edge 65 of control collar 66. This makes it possible to reduce e.g. an impermissibly high pressure—which is explained initially in the prior art—in working connection A and in the line section connected thereto, into an intermediate space 100 of displacement control valve arrangement 1 without a load pressure in working connection A or in the line section decreasing.

Intermediate space 100 is situated axially between control edge 65 of control collar 66 and control edge 42, and is bounded in sections by valve bore 24 and valve spool 22. The diameter of valve spool 22, between control edge 65 and connecting member 94, corresponds approximately to the minimal diameter of connecting member 94.

Opening precontrol 84 as described above enables a compression relief volume to flow out and, therefore, for an impermissibly high pressure to be reduced in working passage 14, in control chamber 34, and in intermediate space 100 to be reduced. If the displacement of valve spool 22 to the left, as shown in FIG. 2, causes precontrol 84 to be closed once more, the pressure in working passage 14, control chamber 34, and intermediate space 100 is reduced via gap leakage between control collar 66 and valve bore 24 toward discharge passage 18, and via gap leakage between the control collar assigned to control edge 42 and valve bore 24 toward intermediate passage 38, and, from there to tank line 62. The opening of precontrol 84 of blocking valve 10 toward discharge passage 18 in order to reduce pressure when a pressure-medium connection exists that is controlled closed by control edge 65 of control collar 66 of valve spool 22 is referred to as a pressure-relief cycle.

To allow pressure medium to flow out of a consumer via working connection A and blocking valve 10, valve spool 22 is displaced to the right as shown in FIG. 2, wherein plunger 92 is moved via connecting member 94 in the direction of blocking valve 10 as described above. After precontrol body 86 has been opened, a pressure difference between the pressure in working passage 14, control chamber 34, and intermediate space 100, and the pressure in working connection A is reduced. When valve spool 22 is displaced further, end section 96 plunges entirely into auxiliary bore 90 of blocking valve 10, and plunger 92 pushes blocking valve body 68, which is substantially pressure-compensated, in the opening direction, wherein the pressure-medium connection from working passage 14, control chamber 34, and intermediate space 100 to discharge line 18 is controlled open by control collar 66 of valve spool 22. The displacement travel of valve spool 22 of directional control valve 8 is detected using a displacement sensor 102 connected thereto; see FIG. 1. Displacement sensor 102 is connected approximately coaxially to valve spool 22, on the left as shown in FIG. 1, to housing 2. Furthermore, valve electronics 104, which include a temperature sensor 103, are situated on housing 2. The displacement travel and duration of displacement of valve spool 22 can be controlled exactly using displacement sensor 102 and valve electronics 104, thereby making it possible to adjust the timing and duration of the pressure-relief cycles.

The pressure relief of working connection A via blocking valve 10 having a pressure-relief cycle is timed e.g. as a function of a temperature increase that is measured in the line section connected to working connection A. In one pressure-relief cycle, compression volume can be reduced by approximately 0.16 ml at a load pressure of 250 bar.

The duration of the opening time of precontrol 84 of blocking valve 10 depicted in FIG. 2 is not at all critical in a pressure-relief cycle since no load pressure is released to tank port T.

No additional installation space is required for the pressure-relief device. The pressure-relief cycles can be controlled e.g. using vehicle electronics or valve electronics 104.

Figure 3:
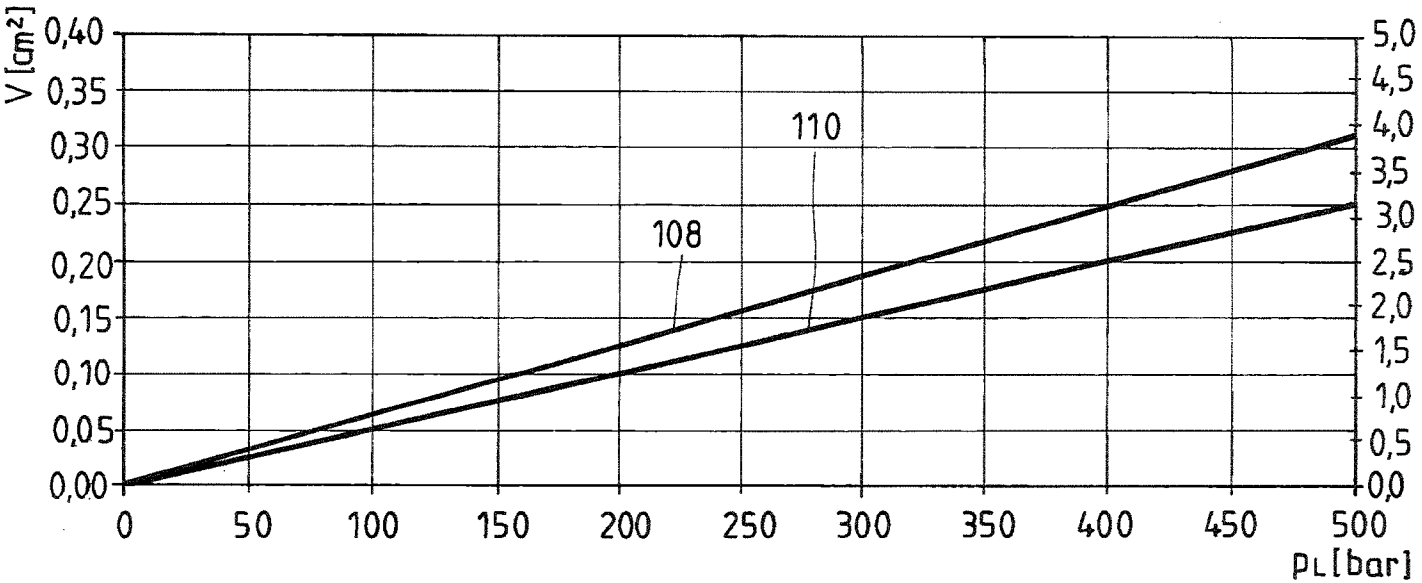
FIG. 3: a diagram showing compression volume as a function of a load pressure.

FIG. 3 shows a diagram in which compression volume, i.e. pressure-relief volume, is plotted in $cm^3$ and % against load pressure in bar in working connection A shown in FIG. 2. An upper graph 108 depicted in FIG. 3 is a plot of compression volume in $cm^3$ as a function of load pressure. As load pressure increases, compression volume likewise increases, in an approximately linear manner. For example, at a load pressure of 350 bar, compression volume can be reduced by approximately 0.22 $cm^3$ in the pressure-relief cycle. A lower graph 110 shown in FIG. 3, which is a plot of compression volume in % as a function of load pressure, is flatter than graph 108. Due to the linear correlation between compression volume and load pressure, the reduction in compression volume over the pressure-relief cycles can be controlled more easily and exactly at different load pressures.

Figure 4:
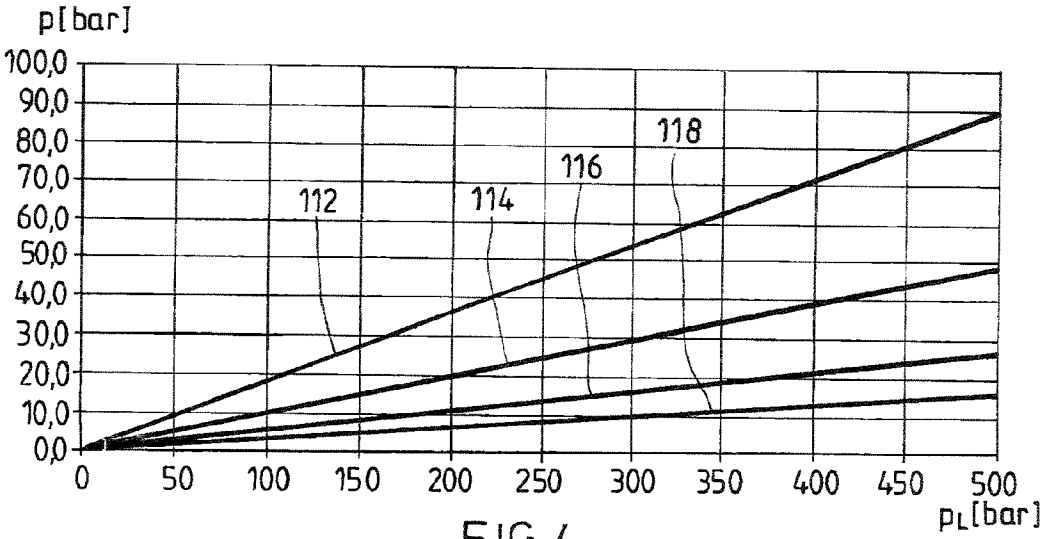
FIG. 4: a diagram showing pressure decrease as a function of load pressure.

FIG. 4 shows a further diagram in which load pressure is plotted in bar on the x-axis, and pressure reduction is plotted on the y-axis, likewise in bar. Four graphs 112, 114, 116 and 118 are shown, in which pressure reduction is plotted as a function of load pressure at different tube lengths of 50, 100, 200 and 400 cm, respectively, using diameters of a tube connected to working connection A in FIG. 2 as an example.

Pressure reduction is a measure of the pressure that is reduced in one pressure-relief cycle in working connection A and the tube connected thereto.

Graphs 112 through 118 increase approximately linearly with load pressure, wherein the slope of each graph 112 through 118 becomes flatter as the tube length increases. For example, given a tube length of 50 cm, the pressure reduction, i.e. the amount of pressure that is relieved in one pressure-relief cycle, is approximately 60 bar at a load pressure of 350 bar, as indicated by upper graph 112 in FIG. 4. Given a tube length of 400 cm, the pressure reduction is approximately 10 bar at the same load pressure, as indicated by graph 118.

Figure 5:
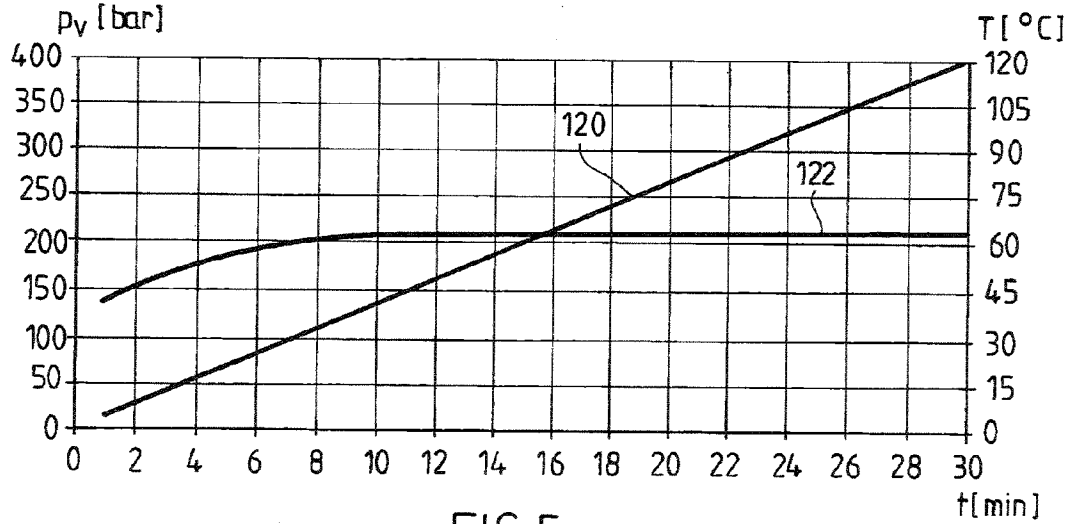
FIG. 5: a diagram showing load pressure and temperature increase as a function of time.

FIG. 5 shows a diagram in which load pressure and temperature are plotted as a function of time. The x-axis represents time in minutes, the y-axis on the left in FIG. 5 indicates load pressure in bar, and the y-axis on the right represents a temperature increase in a tube having a length of 200 cm that is connected to working connection A depicted in FIG. 2. The temperature increase, which is due e.g. to solar radiation, should be approximately 4° C. per minute, as indicated by graph 120, which is approximately linear, in FIG. 5. At an outlet load pressure of 100 bar, approximately four pressure-relief cycles are provided every minute. A graph 122 that depicts load pressure as a function of time approaches a pressure of 210 bar in an approximately asymptotic manner. This demonstrates that, due to the pressure-relief cycles, load pressure does not increase any further even as temperature increases, thereby preventing excessive pressure from forming in a tube connected to working connection A.

Disclosed herein is a directional control valve arrangement that comprises a directional control valve that includes a valve spool. Using the directional control valve, it is possible to control a pressure-medium connection between a pressure port, a tank port, and at least one working connection. A blocking valve is situated in a working passage that is connected to the working connection. The pressure in the working passage can be reduced using a pressure-relief unit, wherein the pressure-medium connection between the working passage and the tank port is blocked by the valve spool. The pressure-relief unit has an intermediate space which is formed in the pressure-medium flow path between the blocking valve and a control edge of the valve spool that blocks the working passage to the tank port, the intermediate space being provided to accommodate a compression volume of the working passage. The intermediate space can be connected to the working passage by controlling-open the blocking valve, wherein the connection to the tank port is blocked by the control edge of the valve spool.

It will be understood that each of the elements described above, or two or more together, may also find a useful application in other types of constructions differing from the types described above.

While the invention has been illustrated and described as embodied in a device having a torque-limiting unit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A directional control valve arrangement, comprising:

a directional control valve (8) including a valve spool (22);

a pressure-medium connection between a pressure passage (P), a discharge passage (18), and two working passages (14, 16), wherein said pressure-medium connection is controllable via said valve spool (22);

a releasable blocking valve (10) provided in a first working passage (14), wherein the releasable blocking valve (10) is arranged between a first section of the first working channel (14) leading to the valve spool (22) and a second section of the first working channel (14) leading to an outer working connection (1), wherein when the first working channel (14) is blocked via the valve spool (22) toward the tank port (18), the second section of the first working channel (14) is relieved of pressure;

wherein an intermediate space (100) in the pressure-medium flow path between the blocking valve (10) and a control edge (65) of the valve spool (22) that blocks the working passage (14) toward the tank port (18) is provided to accommodate a compression volume from the second section of the first working passage (14), and wherein the intermediate space (100) is connectable to the second section of the first working passage (14) by controlling open the blocking valve (10) when the discharge passage (18) is blocked by the control edge (65).

2. The directional control valve arrangement according to claim 1, wherein the blocking valve (10) includes a precontrol (84).

3. The directional control valve arrangement according to claim 2, wherein the blocking valve (10) and the precontrol (84) of the blocking valve (10) are configured to be controlled open mechanically.

4. The directional control valve arrangement according to claim 3, wherein the blocking valve (10) and the precontrol (84) are configured to be controlled open using a plunger (92), wherein said plunger (92) is actuatable in the control-open direction using a connecting member (94) on the valve spool (22).

5. The directional control valve arrangement according to claim 4, wherein the connecting member (94) is formed approximately between the control edge of the valve spool (22) that blocks the working passage (14) to the discharge passage (18) and the control edge of the valve spool (22) that blocks the pressure passage to the working passage (14).

6. The directional control valve arrangement according to claim 1, wherein a timing of a pressure relief of the working passage (14) using pressure-relief unit (10, 65, 100) is dependent on a temperature increase that is measured and/or on a load pressure that is measured.

7. The directional control valve arrangement according to claim 6, wherein the temperature increase that is measured and/or load increase that is measured is in the working passage (14).

8. The directional control valve arrangement according to claim 1, wherein the intermediate space (100) is partially bounded by a control collar (66) of the valve spool (22) that forms the control edge (65).

9. The directional control valve arrangement according to claim 1, wherein gap leakage is provided between the intermediate space (100) and the discharge passage (18) via the valve spool (22).

10. The directional control valve arrangement according to claim 1, wherein a displacement sensor (102) is connected to the valve spool (22) of the directional control valve (8).

11. The directional control valve arrangement according to claim 1, wherein an electronic assembly (104) for controlling open the directional control valve (8) is situated on the directional control valve arrangement (1).

* * * * *